US005690424A

United States Patent [19]

Warshauer et al.

[11] Patent Number: 5,690,424

[45] Date of Patent: Nov. 25, 1997

[54] MOUNTING APPARATUS FOR LIGHTING FIXTURES

[75] Inventors: Mark Warshauer, Venice; James Schwartzman; William Schiffman, both of Los Angeles, all of Calif.

[73] Assignee: Justice Design Group, Inc., Culver City, Calif.

[21] Appl. No.: 437,179

[22] Filed: May 8, 1995

[51] Int. Cl.[6] ..... F24V 29/00

[52] U.S. Cl. ..... 362/373; 362/294; 362/404

[58] Field of Search ..... 362/294, 345, 362/373, 391, 403, 404, 407, 361

[56] References Cited

U.S. PATENT DOCUMENTS

| | | | |
|---|---|---|---|
| 4,750,096 | 6/1988 | Lim | 362/294 |
| 4,872,097 | 10/1989 | Miller | 362/373 |
| 4,985,815 | 1/1991 | Endo | 362/345 |

FOREIGN PATENT DOCUMENTS

| | | | |
|---|---|---|---|
| 203097 | 10/1948 | Austria | 362/294 |
| 937259 | 3/1948 | France | 362/407 |

*Primary Examiner*—Y My Quach

*Attorney, Agent, or Firm*—Fish & Richardson P.C.

[57] ABSTRACT

A lamp having a source of electrical power, an illuminating element, a base, a globe-like transparent or translucent housing around the illuminating element, the globe having facial features formed in relief on an outer surface thereof and having an upper structure consisting of ears, fur, hair or a head covering such as a hat. The lamp preferably has a plurality of brightness levels and is suitable for illumination of a juvenile environment and for use as a night light. The globe-like housing is designed so that heat from the illuminating element is transferred to the environment without an unacceptable internal heat buildup or fire hazard.

12 Claims, 3 Drawing Sheets

MOUNTING APPARATUS FOR LIGHTING FIXTURES

BACKGROUND OF THE INVENTION

1. Field of the Invention

The invention relates to lighting fixtures. More specifically, the invention relates to an apparatus to mount a lamp shade to a lighting fixture, particularly a hanging lighting fixture.

2. Description of Related Art

Lighting fixtures for suspension from a ceiling or other raised surface are popular means for providing light to an area in a decorative, space-efficient manner. Typically, such fixtures are suspended by a cord or similar extended support means which include insulated electrical wiring for connection of the fixture to a power source ("wiring cord"). Preferably, the fixture is provided with protective features to guard against wear of the wiring cord, heat damage to the fixture components, and the like.

For example, in a hanging fixture, the weight of the lamp places substantial strain on the wiring cord. Thus, to avoid damage to the cord and to stabilize the fixture, strain relief mechanisms have been developed. Such mechanisms typically consist of at least one compression mechanism, such as nut and bolt combinations through which the wiring cord for the fixture is passed.

Use of a compression mechanism to attach a lamp shade to the lighting fixture provides both strain relief and means to secure the shade in a single mechanism. However, one drawback of this approach is that compression of the shade against another surface to secure it to the lighting mechanism poses the risk that the shade will be damaged. This risk is particularly acute for fragile shades, such as those made of ceramic or glass.

An additional protective feature of most lighting fixtures is present in the socket mechanism. To avoid damage to the fixture from exposure to heat radiating from the socket mechanism and bulb, socket mechanisms typically include a heat sink; i.e., a material which will absorb heat produced by the fixture away from other elements of the lamp. Examples of such heat sinks include insulation lining the socket or metals used to form the socket mechanism itself. In addition, in part to limit exposure of the shade to heat produced by the fixture, the socket mechanism is usually physically separated from the point of attachment of the shade to the fixture.

If more than one of these protective features could be combined into a single, integrated mechanism, the manufacture and use of lighting fixtures would be simplified. The present invention addresses that need.

SUMMARY OF THE INVENTION

The details of the preferred embodiment of the present invention are set forth in the accompanying drawings and the description below. Once the details of the invention are known, numerous additional innovations and changes will become obvious to one skilled in the art.

In one aspect, the invention is a mounting apparatus for securing a shade to a lighting fixture without mechanical attachment or compression of the shade. In this aspect of the invention, the shade is secured to the inventive mounting apparatus by means of gravity.

In another aspect, the invention is a heat sink which is integrally a part of the mounting apparatus.

In another aspect, the invention is a strain relief device which is integrally a part of the mounting apparatus.

BRIEF DESCRIPTION OF THE DRAWINGS

Like reference numbers and designations in the various drawings refer to like elements.

DETAILED DESCRIPTION OF THE INVENTION

Throughout this description, the preferred embodiment and examples shown should be considered as exemplars, rather than limitations on the present invention.

Figure 1:
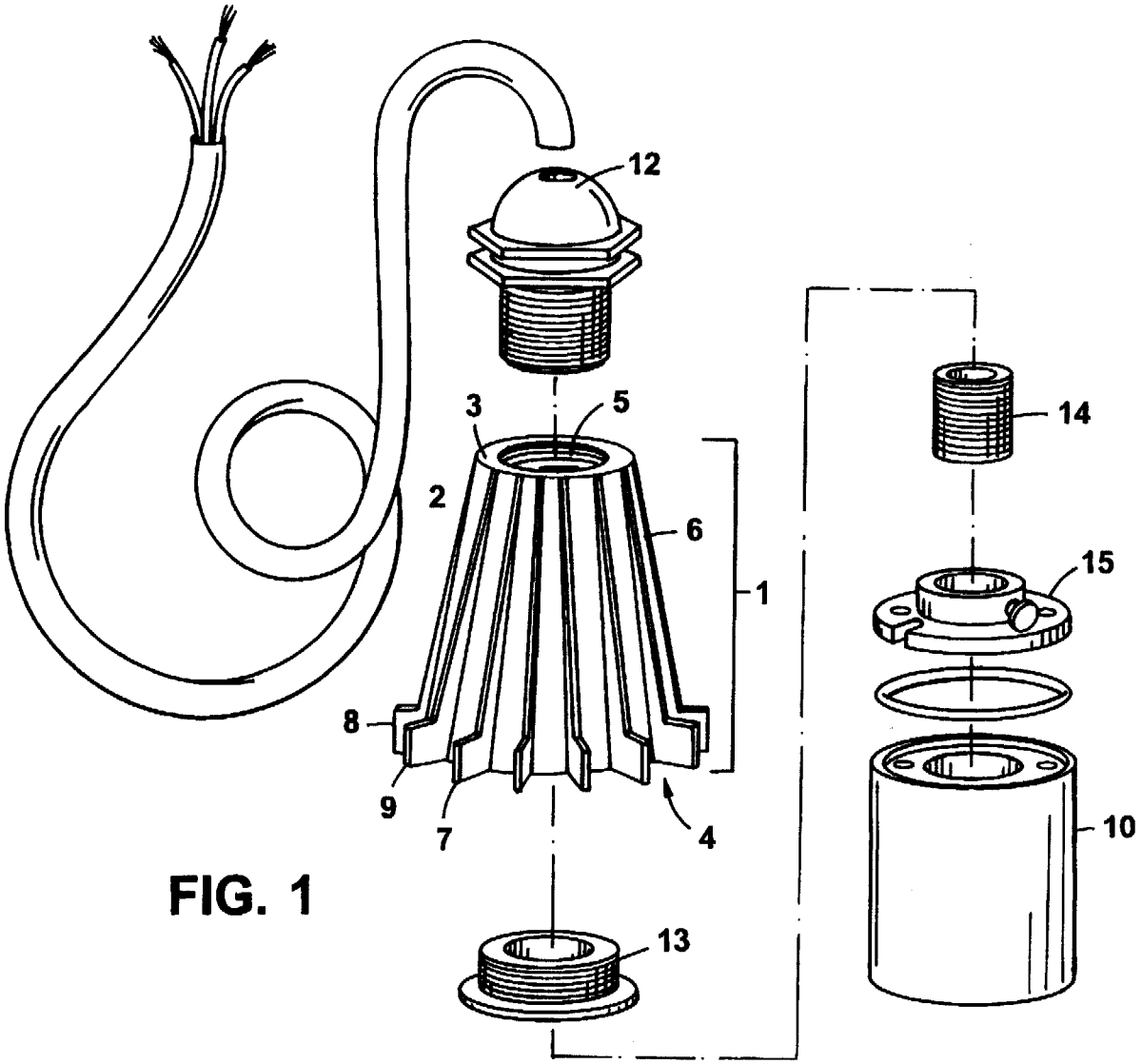
FIG. 1 is a side view of a lighting fixture having the mounting and socket apparatuses of the invention.
Figure 2:
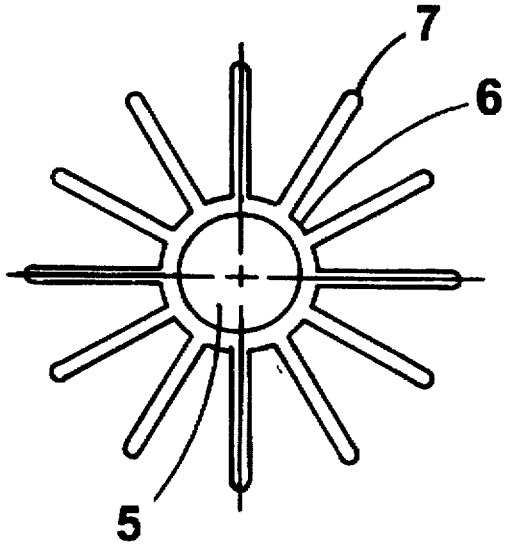
FIG. 2 is a bottom plan view of the mounting apparatus of the invention.

As best shown in FIG. 1, mounting apparatus 1 consists of a cylindrical body 2. For purposes of this description, surface 3 of mounting apparatus 1 shall be referred to as the anterior end of the apparatus, while surface 4 of mounting apparatus 1 shall be referred to as the posterior end of the apparatus. In bottom plan view (FIG. 2), it can be seen that a bore 5 extends vertically through body 2 from its anterior end to its posterior end.

Bore 5 is defined by the inner diameter of the wall 6 comprising body 2. The inner diameter of bore 5 may be of any size required to accommodate the socket apparatus and cord of a lighting fixture with which the mounting apparatus is to be used. For use with most wiring cords, it will be adequate for bore 5 to have an inner diameter of about 0.5 to 1.5 inches, most commonly about 1 inch. However, because mounting apparatus 1 will preferably also function as a heat sink to absorb heat from a bulb, wall 6 will preferably have a thickness of 0.0625 inches or more (preferably not exceeding the thickness of the fins described below), with a wall of approximately 0.0625 inches in thickness being a size suitable for use in most hanging lighting fixtures.

Radiating outward at an angle of at least about 90° from wall 6 of body 2 are a multiplicity of fins 7. In this context, multiplicity refers to at least 3, and preferably at least 6, fins. Viewed in cross-section (FIG. 3), each fin 7 has an upper surface 8 and bottom surface 9. For maximal stability, bottom surface 9 extends to bore 5 to form the posterior end of body 2. Thus, fins 7 will preferably each radiate outward from the posteriormost region of wall 6.

Figure 4:
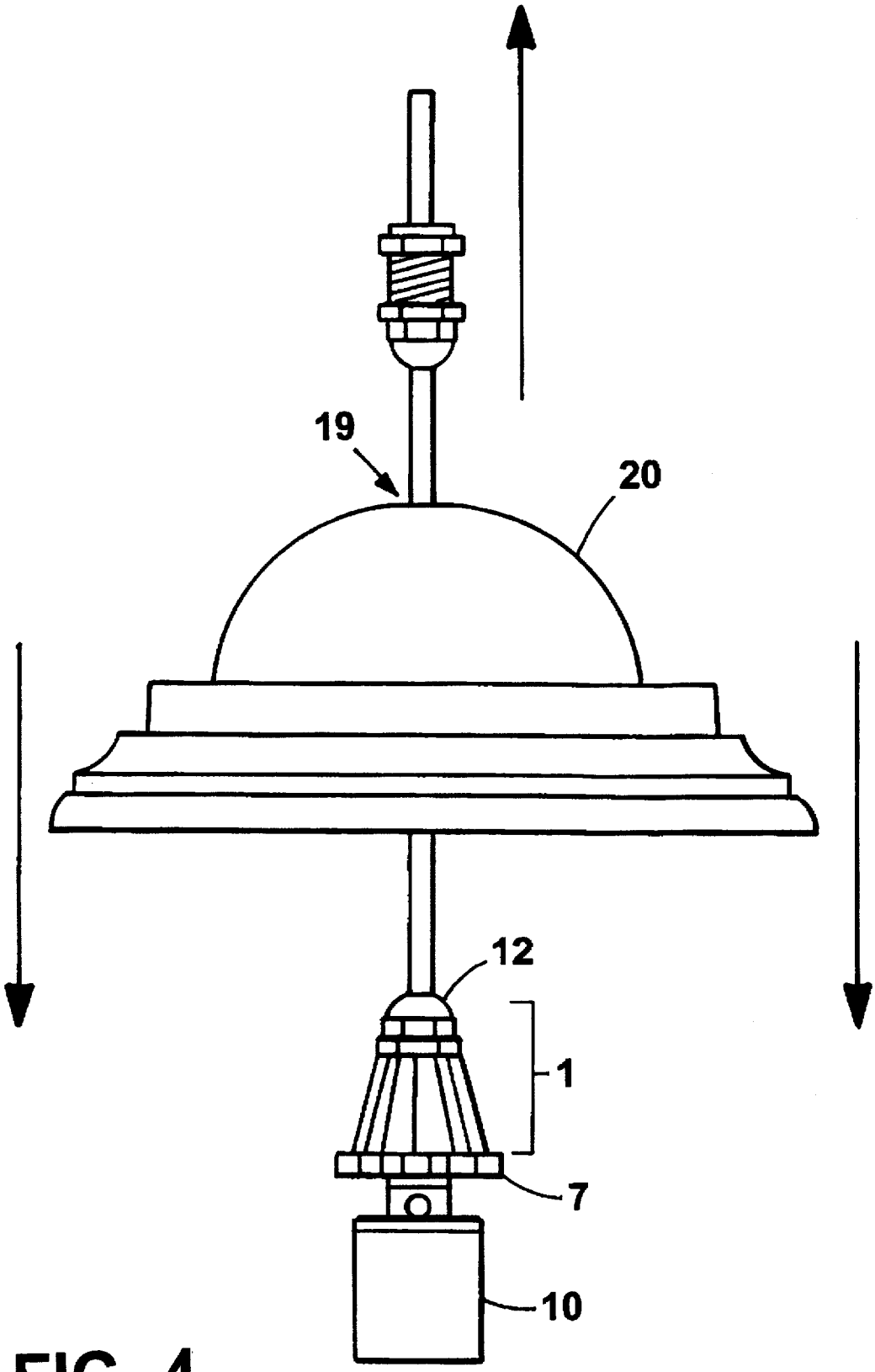
FIG. 4 is a side view of a lighting fixture having the mounting and socket apparatuses of the invention, showing how a shade is seated on the former. The arrows indicate movement of the shade along a wiring cord.

Upper surface 8 of each of fins 7 must have a minimum surface area available for support of a lamp shade. In this respect, FIG. 4 illustrates how a lamp shade is seated upon each of fins 7. As shown in FIG. 4, mounting apparatus 1 and socket mechanism 10 of the invention are passed through an upper center opening 19 in a lamp shade 20. To mount lamp shade 20, the shade is lowered onto the upper surfaces of fins 7, where it will be held in place by downward gravitational force onto lamp shade 20 and fins 7.

Hence, fins 7 must be of sufficient horizontal length to extend beneath the inner surface of shade 20 beyond the diameter of center opening 19. The horizontal length of the fins will therefore vary depending on the shape of the lamp shade and size of the center opening through the lamp shade. On average, it can be expected that a total horizontal fin length of about 0.25 to 1 inches from the point of attachment to wall 6 will be adequate to support most shades available for use on hanging light fixtures. Of such shades, particularly preferred shades are ceramic shades manufactured by Justice Design Group, Inc., Culver City, Calif., under the tradenames RADIANCE PENDANTS™ and AMBIANCE™ SCONES.

Figure 3:
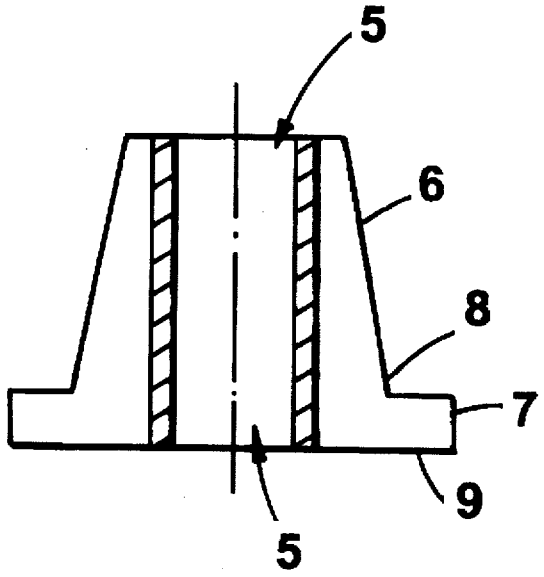
FIG. 3 is a cross-sectional view of the mounting apparatus of the invention.

As shown in FIG. 3, wall 6 of body 2 forms a funnel which widens from anterior end 3 to posterior end 4. In this preferred configuration, bore 5 passes vertically through body 2. Those of ordinary skill in the art will appreciate that other configurations may be used; e.g., where the outer surface of wall 6 is relatively straight or slopes inwardly from anterior end 3 to posterior end 4.

In use, mounting apparatus 1 will preferably be clamped by clamping means onto the wiring cord of a hanging lighting fixture. As shown in FIGS. 1 and 4, the clamping means is fitted to mounting apparatus 1 through bore 5 and is attached via one or more fastening means to bulb socket 10 to form a mounting apparatus integrally comprised of mounting apparatus and socket 10, as well as clamping and fastening means. The clamping means may consist of any apparatus through which a cord may be run into a bulb socket, but will conveniently be a threaded bolt 12 which attaches to a complementary thread in bore 5 at the anterior end of mounting apparatus 1.

In this embodiment, threaded bolt 12 extends beyond the anterior end of bore 5 and through about ¼ to ⅞ of the bore's length. A threaded reducer 13 with threading complementary to that of threaded bolt 12 is fitted to the posteriormost end of bolt 12 within bore 5. Opposite the point of attachment of reducer 13 to bolt 12, reducer 13 is attached to threaded nipple 14. Nipple 14 is threaded in complementary fashion to attach both to reducer 13 as well as to threaded nut 15 of the anterior end of socket 10. Thus, a secure attachment is formed between bolt 12 at the anteriormost end of mounting apparatus 1 and nut 15 at the anteriormost end of socket 10.

Further, each of fastening elements 12, 13, 14 and 15 will have a bore extending vertically therethrough to allow a wiring cord to pass through each element for attachment by conventional means to bulb socket 10. With the combination and attachment of all of these elements, the fixture is provided with an integrated structure for securing the wiring cord to the socket and securing the shade to the fixture.

The threaded parts described have the advantage of being separable yet relatively secure and simple to attach together as compared to other fastening means. However, other means of fastening the clamping means to socket 10 through bore 5 will be apparent to, or may be readily identified by, those of ordinary skill in the art. For example, the threaded aspect of bolt 12 could instead attach to socket 10 by locking together in a mechanical attachment (such as fitting an "T" shaped stem from bolt 12 into a slot through the anteriormost surface of socket 10), or by a friction attachment (e.g., by forming an interference fit between adjoining elements of the clamping means and socket mechanism). Alternatively, the clamping means could be attached to socket mechanism 10 by more permanent means, such as by soldering or gluing the parts together.

Further, mounting apparatus 1 could be fastened to socket mechanism 10 at the latter's anteriormost end by fitting bore 5 of mounting apparatus 1 over an unthreaded stem (or by other male/female attachment). A similarly passive attachment could be made between the wiring cord and the mounting apparatus at the latter's anteriormost end by narrowing the inner diameter of bore 5 to just fit over the outer diameter of the wiring cord. Although less secure than the joining means and clamping means attachments described above, the passive fastening elements of this alternative embodiment have the advantage of being very simple to attach and detach from one another.

The preferred clamping means for use in the invention is a compression mechanism. In this embodiment of the invention, nut 12 is a conventional screw-on compression mechanism such as the strain relief device available from Heyco Molded Products of Kenilworth, N.J. Thus, by attaching a strain relief device directly onto mounting apparatus 1 and suspending the socket 10 securely from the strain relief device according to the invention, a single integrated structure can provide strain relief, shade support and a socket mechanism for a lighting fixture.

Advantageously, mounting apparatus 1 may also function as a heat sink. In this embodiment of the invention, heat is wicked away from the surface of socket mechanism 10 and shade 20 by absorption of heat by both body 2 and fins 7. To this end, mounting apparatus 1, including the bore 5, will either be constructed of, or coated with, a heat absorbent material which has high thermal conductivity as well as high specific heat and melting points. Such materials will be known to those of ordinary skill in the art; for example, preferred materials which meet this criteria include the metals copper, graphite, beryllium, beryllium oxide and aluminum, as well as refractory ceramics such as chromite.

Also, to increase the surface area of mounting apparatus 1 available for heat absorption, raised ridges may be included along wall 6. The ridges may be horizontal or vertical. If the latter, each ridge may terminate at a fin as shown in FIG. 1. Most preferably, the heat absorbent material used to form mounting apparatus 1 will be aluminum, which may be extruded to form a seamless combination of body 2 and fins 7. For corrosion resistance, the aluminum may be anodized or covered with heat resistant paint (i.e., paint including aluminum chips or particles).

On review of the above description, it will become apparent to those of ordinary skill in the art that various modifications may be made without departing from the spirit and scope of the invention. Accordingly, it is to be understood that the invention is not to be limited by the specific illustrated embodiment, but only by the scope of the appended claims.

I claim:

1. An apparatus for mounting a lamp shade to a suspended lighting fixture, comprising:

a. a body of said lighting fixture configured to fasten to a bulb socket, which body is defined by a wall having an outer surface and having a bore extending vertically; through the body;

b. at least three fins extending outwardly from the outer surface of the wall, wherein each fin has a horizontal length from its point of attachment to the outer surface of the wall, said horizontal lengths of said fins sufficiently supporting a free-resting lamp shade; and c. means for securing the body to a suspended wiring cord.

2. The apparatus according to claim 1, wherein the body has an anterior end opposite a posterior end and an outer diameter, wherein the outer diameter of the body is widest at its posterior end.

3. The apparatus according to claim 2, wherein the fins extend radially from approximately the posterior end of the wall.

4. The apparatus according to claim 1, further comprising means for fastening the body to a bulb socket.

5. The apparatus according to claim 1, wherein the means for securing is a compression mechanism for relief of strain on the wiring cord.

6. The apparatus according to claim 1, wherein the body and fins are constructed of a heat absorbent material.

7. The apparatus according to claim 6, wherein the heat absorbent material is a metal.

8. The apparatus according to claim 7, wherein the heat absorbent metal is aluminum.

9. The apparatus according to claim 1, wherein the outer surface of the wall has at least 3 ridges.

10. The apparatus according to claim 9, wherein each ridge terminates at a corresponding one of the fins.

11. The apparatus according to claim 1, wherein the body and fins are coated with heat resistant paint.

12. The apparatus of claim 1, wherein the bore is coated with a heat absorbent material.

* * * * *